US005926845A

United States Patent [19]

Troyer

[11] Patent Number: 5,926,845

[45] Date of Patent: Jul. 27, 1999

[54] COAT

[76] Inventor: Bill Troyer, 9130 Township Rd. 556, Millersburg, Ohio 44654

[21] Appl. No.: 09/041,945

[22] Filed: Mar. 13, 1998

[51] Int. Cl.[6] ..... A41D 1/00

[52] U.S. Cl. ..... 2/93; 2/69.5; 2/85

[58] Field of Search ..... 2/69.5, 93, 94, 2/85, 247, 69, 108

[56] References Cited

U.S. PATENT DOCUMENTS

| | | | |
|---|---|---|---|
| 762,772 | 6/1904 | Terramorse | 2/85 |
| 1,011,339 | 12/1911 | Golick | 2/93 |
| 1,234,564 | 7/1917 | Prestwich | 2/86 |
| 1,330,152 | 2/1920 | Wilson | 2/85 |
| 1,854,476 | 4/1932 | Mason | 2/85 |
| 5,159,718 | 11/1992 | Moyer . | |
| 5,228,140 | 7/1993 | Baustin | 2/93 |

*Primary Examiner*—Gloria Hale

*Attorney, Agent, or Firm*—Sand & Sebolt

[57] ABSTRACT

A full-length coat extending from a user's neck to ankles. The coat includes buttons and buttonholes along a front thereof to retain the coat in a closed configuration. A vertical slit is formed in a rear of the coat and extends downwardly from slightly below the user's waist. The slit forms a right and left rear flap which may be interconnected with a button and buttonhole on an inner lower corner thereof. The right and left rear flaps are pulled between and wrapped around the user's right and left legs, respectively, in a pants-like manner to provide increased mobility to the user. The inner comers of the right and left rear flaps are connected to the lower-most button and buttonhole of the front of the coat to retain the flaps in the pants-like configuration. A pair of horizontal slots are formed in the front of the coat which allow access to the user's trousers or trouser pockets worn underneath the coat. A small apron is attached slightly above the slot and is moveable between open and closed positions. When in the closed position, the apron prevents water, dirt, or debris from flowing through the slots.

20 Claims, 3 Drawing Sheets

COAT

BACKGROUND OF THE INVENTION

1. Technical Field

Generally, the invention relates to coats. Particularly, the invention relates to a full-length coat which extends down to a user's ankles, yet is adaptable to provide substantial mobility. More particularly, the invention relates to a full-length coat having a back center slit creating a pair of rear flaps which are buttoned together when the coat is worn normally and which may be unbuttoned and pulled between and wrapped around the user's legs in a pants-like manner for increasing the mobility of the user.

2. Background Information

Coats, and particularly long or full-length coats, are worn during cold and inclement weather to keep a user warm. Long coats, such as trench coats, typically extend from the user's neck to slightly below the knees. These coats button up the front to retain body heat and keep the user warm.

One problem with these trench coats is that they extend only to slightly below the knees leaving the lower portion of the legs exposed to the cold and inclement weather. Thus, it would be beneficial to have a coat which extends all the way down to the ankles to protect the user's entire body from neck to feet. The problem with such a coat is that the coat encloses the user's legs and greatly impedes the mobility and flexibility of the user. These full-length coats tend to bind or possibly tear when the user bends or squats. Often full-length coats include a slit with a piece of material extending between and connected to the flaps created by the slit. This only partially addresses the problem as the coats still have a tendency to bind and bunch when the user sits down. Further, even with the slit, full-length coats do not allow a user to straddle a horse, motorcycle, or all-terrain vehicle (ATV).

One environment in which it is desirable to wear a full-length coat is during hunting. Hunters spend a great deal of time outdoors while hunting game. Because most hunting seasons are limited in duration and are generally during the winter season, hunters stay outside for extended periods of time. It is essential that hunters wear warm clothing to retain their body heat and keep themselves warm. Typically, hunters wear overalls to protect themselves from the cold weather. These overalls are bulky and make it difficult to move, especially when the hunters put on their hunting boots.

Because of the bulkiness of overalls, hunters prefer to wear long or full-length coats. These full-length coats tend to bind during squatting and bending, and restrict the mobility of the hunter. Often, hunters will ride horses, motorcycles, or ATVs into the wooded hunting grounds. Full-length coats restrict the ability of the hunter to straddle and ride such animals and vehicles. Also, hunters will often perch themselves on tree stands to gain better visibility to the wooded hunting grounds. These full length coats restrict movement of the hunter and prevent the hunter from climbing trees and/or sitting while elevated in the tree.

Therefore, the need exists for an improved coat which covers a user from neck to ankle to retain the body heat of the user and protect the user from inclement weather, and which can be easily altered to allow the user to be substantially mobile while still keeping the user warm.

SUMMARY OF THE INVENTION

Objectives of the invention include providing an improved coat which covers a user from neck to ankle.

A further objective is to provide a coat which retains the body heat of a user and protects the user from inclement weather.

Another objective is to provide a coat which allows the user to bend, squat, straddle a horse, motorcycle, ATV and the like, or climb onto and sit in a tree stand.

A still further objective is to provide a coat formed with a pair of side slots which allow access to the users trousers.

A further objective is to provide a coat in which a flap or apron extends over each slot to prevent water from flowing therethrough.

An additional objective is to provide a coat formed with a back slit which forms a pair of rear flaps.

Another objective is to provide a coat in which the rear flaps are connected to one another during normal use; and in which the flaps maybe wrapped between and around the users legs and attached to a front of the coat in a pants-like manner for increasing the user's mobility.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT(S)

Figure 1:
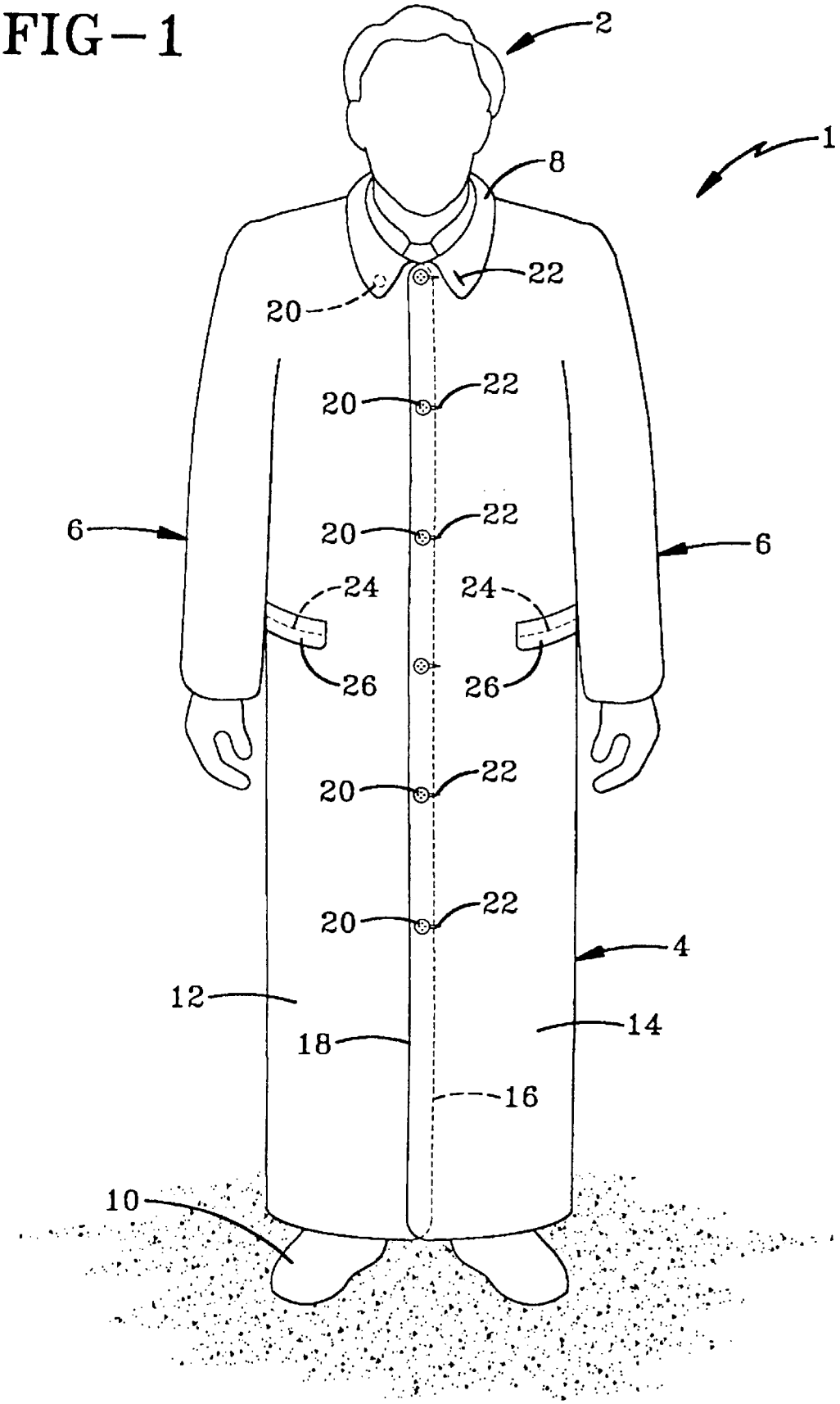
FIG. 1 is a front elevational view of the coat of the present invention.

The coat of the present invention is indicated generally at 1 in FIG. 1 and is shown being worn by a person or user 2. Coat 1 includes an elongated body 4, a pair of sleeves 6 and a collar 8 which extends around the neck of user 2. Body 4 of coat 1 extends from the neck of user 2 down and adjacent to the ankles of the user slightly above the user's feet 10. Arms 6 extend from the users shoulder region to adjacent the wrists and arms.

Coat 1 includes a right side 12 and a left side 14 having inner edges 16 and 18, respectively. A plurality of buttons 20 are sewn or otherwise attached to right side 12 adjacent inner edge 16 which interact with a corresponding number of buttonholes 22 formed in left side 14 adjacent inner edge 18. The lower-most button and buttonhole 20 and 22, respectively, preferably are positioned slightly above the user's knee area when coat 1 is being worn, but may be adjacent or below the user's knee depending on the size and height of user 2. Buttons 20 extend through buttonholes 22 as shown in FIG. 1 to releasably fasten right side 12 to left side 14 placing coat 1 in a closed configuration. Collar 8 may optionally include a button 20 and a buttonhole 22 allowing the user to fasten the collar in an upwardly extending position to cover the user's neck.

Figure 3:
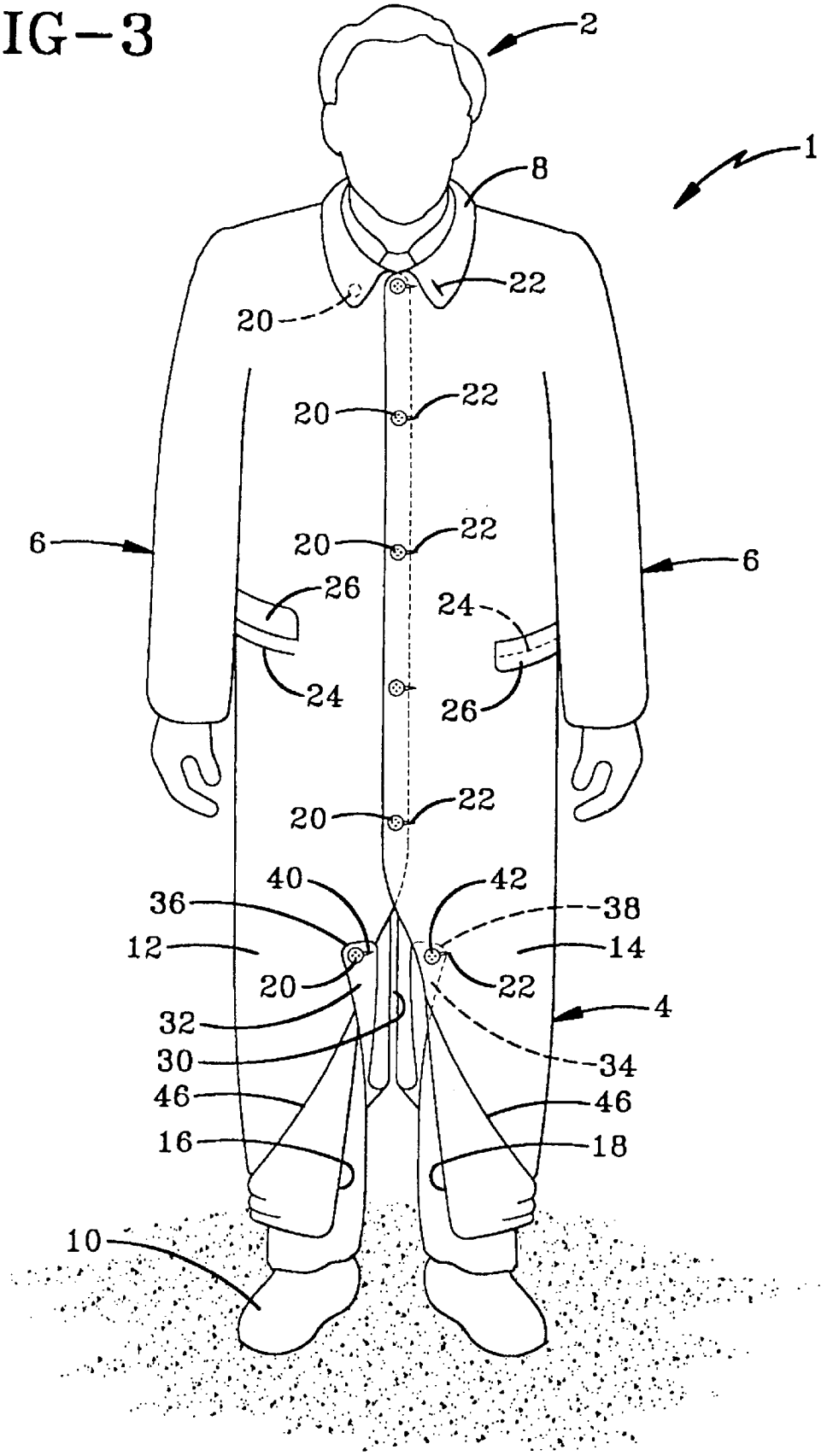
FIG. 3 is a front elevational view of the coat of FIG. 2 shown with the rear flaps wrapped between and around the user's legs and attached to a front of the coat.

A pair of slots 24 are formed in right and left sides 12 and 14 between arms 6 and inner edges 16 and 18, respectively. A small flap or apron 26 is attached to right and left sides 12 and 14, respectively, slightly above slots 24. Aprons 26 cover slots 24 and prevent water, dirt, or debris from flowing through slots 24. Aprons 26 flip between up and down positions (FIG. 3) allowing user 2 to gain access to trousers or undergarments worn beneath coat 1. A small releasable fastener, such as a button, snap, or strip of hook and pile fabric, may be attached to apron 26 and slightly below slots 24 to releasably retain aprons 26 in the closed position.

Figure 2:
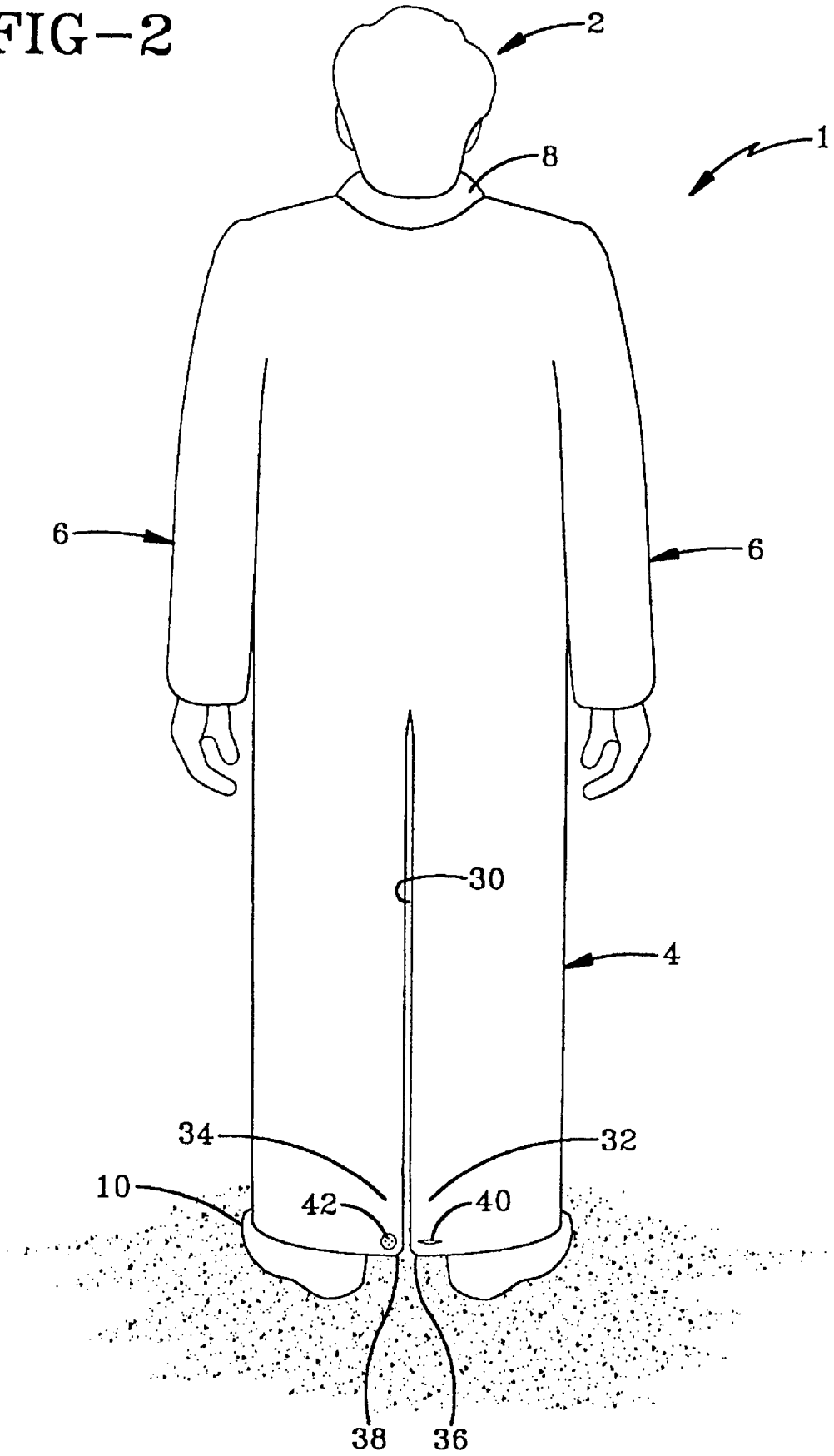
FIG. 2 is a rear elevational view of the coat of FIG. 1 showing the rear flaps in an unconnected configuration.

In accordance with the main feature of the invention, a long vertical slit 30 is formed centrally in the rear of coat 1 (FIG. 2). Slit 30 extends downward from slightly below the users waist and completely separates the lower portion of right side 12 from the lower portion of left side 14 forming right and left rear flaps 32 and 34, respectively. Right rear flap 32 and left rear flap 34 each have an inner bottom corner 36 and 38, respectively. A buttonhole 40 is formed in right rear flap 32 adjacent inner bottom corner 36 thereof. A button 42 is sewn or otherwise attached to left rear flap 34 adjacent inner bottom corner 38 thereof. Button 42 interacts with buttonhole 40 to attach right rear flap 32 to left rear flap 34 to retain the rear of coat 1 in a closed configuration during normal use.

During normal use, coat 1 is worn in the closed configurations of FIGS. 1 and 2 with buttons 20 engaging buttonholes 22 and button 42 engaging buttonhole 40. Coat 1 retains body heat of the user keeping the user warm and protects the user from neck to ankle repelling rain, snow, and other inclement weather. When coat 1 is worn in the closed configurations of FIGS. 1 and 2, elongated body 4 substantially impedes the mobility and movement of user 2. When all of buttons 20 engage buttonholes 22, the extent of the user's leg movement is limited by the area within body 4.

Often, coat 1 will be worn during activities which require substantial mobility and movement by user 2. Slit 30 allows coat 1 to provide such mobility and movement. Button 42 is unbuttoned from buttonhole 40 as shown in FIG. 2 and the lower-most button 20 is unbuttoned from its respective buttonhole 22. User 2 bends down and reaches between his/her legs and grasps inner bottom corner 36 of right rear flap 32. The user will pull inner bottom corner 36 forward between his/her legs and wrap the inner portion of right rear flap 32 around his/her right leg. The lowest button 20 is then inserted through buttonhole 40 attaching inner bottom corner 36 to inner edge 16 of right side 12 of coat 1. Similarly, the user grasps inner bottom corner 38 of left rear flap 34 and pulls inner flap 34 between his/her legs and wrap the inner position of left rear flap 34 around his/her left leg. Button 42 is inserted through the lower-most buttonhole 22 attaching inner bottom corner 38 to inner edge 18 of left side 14 of coat 1.

When coat 1 is converted to the configuration described above and shown in FIG. 3, the lower portion of coat 1 wraps between and around the user's legs in a pants-like manner. By attaching rear flaps 32 and 34 slightly above the user's knees, the user is free to bend, squat and flex his/her knees without coat 1 binding or restricting the mobility or movement of user 2. Because a portion of coat 1 is being folded over itself, several folds or creases 46 will be formed in the front and rear of coat 1. With the bottom portion of coat 1 separated in the pants-like manner of FIG. 3, the extent of potential separation of the user's legs is greatly increased. The user is capable of straddling and riding a horse, motorcycle, or all-terrain vehicle.

Coat 1 may be manufactured of various materials such as vinyl, or a cloth material preferably coated with a rain resistant chemical. Also, coat 1 may be various colors depending upon the intended use. For example, hunters may desire to have coat 1 camouflaged allowing the hunters to blend in with the wooded hunting grounds.

Accordingly, coat 1 covers user 2 from neck to ankle to retain the user's body heat and protect the user from inclement weather. Slots 24 allow access through coat 1 to the user's trousers and trouser pockets. Aprons 26 cover slots 24 preventing water from flowing therethrough. Buttons 20 interact with buttonholes 22 to place coat 1 in a closed configuration with the lowest button and buttonhole positioned slightly above the user's knees. Button and buttonhole 42 and 40, respectively, fasten left and right rear flaps 34 and 32, respectively, to one another closing slit 30 and protecting the rear of the user from inclement weather. Inner bottom comers 36 and 38 may be pulled between and around the user's legs and fastened to the lower-most button and buttonhole 20 and 22, respectively, of the front of coat 1. Rear flaps 30 and 32 wrap around user's right and left legs, respectively, in a pants-like manner providing the user with substantial movement and mobility.

In an alternative embodiment, buttons 20 and buttonholes 22 may be formed along the entire front of coat 1. Left and right rear flaps 30 and 32 may include a plurality of buttons 42 and buttonholes 40 along the entire length of slit 30. Left flap 34 can be grasped and pulled through the user's legs allowing buttons 42 of left flap 34 to engage the corresponding and aligned buttonholes 22 of left side 14. Similarly, right flap 32 be grasped and pulled through the user's legs allowing buttonholes 40 to receive buttons 20 of right side 12. In this embodiment, right and left flaps 32 and 34, respectively, cooperate with the respective sides 12 and 14 of coat 1 creating a pant leg having seam positioned adjacent to and extending along the inner portion of each leg of the user.

Accordingly, the coat is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the coat is constructed and used, the characteristics of the construction, and the advantageous, new and useful results obtained; the new and useful structures, devices, elements, arrangements, parts and combinations, are set forth in the appended claims.

I claim:

1. A coat adapted to be worn by a user, said coat including:

a body having a right front side, a left front side and a rear;

first fastening means for releasably fastening the right front side of the body to the left front side of the body;

a pair of sleeves;

a slit formed in the rear;

a right rear flap and a left rear flap formed on each side of the slit; and second fastening means for fastening the right rear flap to the left rear flap, said second fastening means being capable of interacting with the first fastening means.

2. The coat defined in claim 1 wherein each flap includes an inner bottom corner.

3. The coat defined in claim 2 wherein the inner bottom corner of the right flap fastens to the inner bottom corner of the left flap.

4. The coat defined in claim 3 wherein the right front side is connected to the right flap; and wherein the left front side is connected to the left flap.

5. The coat defined in claim 4 wherein the slit extends from a bottom of the body partially up the rear of the body.

6. The coat defined in claim 5 wherein the second fastening means includes a button and a buttonhole.

7. The coat defined in claim 6 wherein one of the right and left flap includes the button; and wherein the other of the right and left flap is formed with the buttonhole.

8. The coat defined in claim 7 wherein the right and left front sides of the body each include a vertical inner edge.

9. The coat defined in claim 8 wherein the first fastening means includes a plurality of buttons and a corresponding number of buttonholes.

10. The coat defined in claim 9 wherein one of the right and left front sides of the body includes the buttons; and wherein the other of the right and left front sides of the body is formed with the buttonholes.

11. The coat defined in claim 10 wherein the buttons and buttonholes of the first fastening means are positioned adjacent the vertical inner edges of the respective right and left front sides of the body.

12. The coat defined in claim 1 1 wherein one of the right flap and right front side of the body includes a button; and wherein the other of the right flap and right front side of the body is formed with a buttonhole.

13. The coat defined in claim 12 wherein one of the left flap and left front side of the body includes a button; and wherein the other of the left flap and left front side of the body is formed with a buttonhole.

14. The coat defined in claim 1 further including a slot formed in at least one of the right and left front sides of the body.

15. The coat defined in claim 14 further including an apron attached to the respective right and left front sides which is formed with the slot.

16. The coat defined in claim 15 wherein the apron is attached slightly above the slot and is movable between an open position exposing the slot and a closed position covering the slot.

17. The coat defined in claim 14 wherein each of the right and left front sides is formed with a slot and includes an apron.

18. A coat adapted to be worn by a user, said coat including:

a body having a right front side, a left front side and a rear;

a plurality of buttons attached to one of the right and left front sides of the body;

a plurality of buttonholes formed in the other of the right and left front sides of the body, said buttonholes aligning with and receiving the plurality of buttons;

a pair of sleeves;

a slit formed in the rear;

a right rear flap and a left rear flap formed on each side of the slit and attached to the respective right and left front sides of the body;

a rear button attached to one of the right and left rear flaps;

a rear buttonhole formed in the other of the right and left rear flaps for receiving the rear button; and said rear button selectively cooperating with one of said buttonholes and said rear buttonhole selectively cooperating with one of said buttons such that said right and left rear flaps surround the user's leas in a pants-like manner.

19. The coat defined in claim 18 further including a slot formed in one of the right and left front sides of the body; and further including an apron hingedly attached to the body slightly above the slot, said apron being movable between an open and closed position exposing and covering said slot.

20. The coat defined in claim 18 wherein the plurality of buttons are attached to the right front side of the body; wherein the rear buttonhole is formed in the right flap; wherein the plurality of button holes are formed in the left front side of the body; wherein the rear button is attached to the left flap.

* * * * *